US006402421B1

(12) United States Patent
Ottavi et al.

(10) Patent No.: US 6,402,421 B1
(45) Date of Patent: Jun. 11, 2002

(54) DISCONTINUANCE DEVICE FOR A CENTRAL RESERVE

(75) Inventors: Caroline Ottavi, Boulogne Billancourt; Raymond Olive, Croissy sur Seine; Pierre Calvin, Linas, all of (FR)

(73) Assignee: Colas, Billancourt (FR)

( * ) Notice: Subject to any disclaimer, the term of this patent is extended or adjusted under 35 U.S.C. 154(b) by 0 days.

(21) Appl. No.: 09/597,537

(22) Filed: Jun. 19, 2000

(30) Foreign Application Priority Data

Jun. 18, 1999 (FR) ..... 99 07781

(51) Int. Cl.[7] ..... E01F 15/12; E01F 15/08
(52) U.S. Cl. ..... 404/6; 404/9; 256/13.1
(58) Field of Search ..... 404/6, 9–11; 256/1, 256/13.1

(56) References Cited

U.S. PATENT DOCUMENTS

| | | | | |
|---|---|---|---|---|
| 5,531,540 A | * | 7/1996 | Wasserstrom et al. | 404/6 |
| 5,685,665 A | * | 11/1997 | Lembo | 404/6 |
| 6,022,168 A | * | 2/2000 | Junker | 404/6 |
| 6,059,491 A | * | 5/2000 | Striefel et al. | 404/6 |
| 6,164,865 A | * | 12/2000 | McCallum | 404/6 |
| 6,203,242 B1 | * | 3/2001 | Englund | 404/6 |
| 6,220,780 B1 | * | 4/2001 | Schindler et al. | 404/6 |

FOREIGN PATENT DOCUMENTS

| | | |
|---|---|---|
| DE | 43 33 577 A1 | 4/1995 |
| EP | 0 438 267 A1 | 7/1991 |
| EP | 0 758 698 A1 | 2/1997 |
| FR | 2701 499 A1 | 8/1995 |
| FR | 2741 093 A1 | 5/1997 |

* cited by examiner

*Primary Examiner*—H. Shackelford
*Assistant Examiner*—Alexandra K. Pechhold
(74) *Attorney, Agent, or Firm*—Arent Fox Kintner Plotkin & Kahn

(57) ABSTRACT

A discontinuance device for a central reserve is fitted with a permanent separator for a communication zone between carriageways, provides a closing position to ensure continuity of the separation of the carriageways and opening positions, for traffic emergency and diversion opening positions where the carriageways are connected. The device is made of fabricated metal modules comprising supports driven into the ground. The device includes at least one arm having at least one arm module. The module has two lateral walls. The arm is mobile in rotation around a vertical axle forming a joint at one end thereof. The arm includes at least one pivoting retractable foot containing castors to lift and bring the arm into rotation, and to ensure an easy opening for traffic diversion. A transitionally mobile locking module on the arm provides an emergency opening.

13 Claims, 9 Drawing Sheets

DISCONTINUANCE DEVICE FOR A CENTRAL RESERVE

FIELD OF THE INVENTION

This invention relates to a discontinuance device for a central reserve. It finds applications in the field of road technology and more especially in the technique of carriageway separation.

BACKGROUND OF THE INVENTION

The carriageway separation devices used currently can be classed into two large groups in relation to their behaviour in case of shock.

The first group exhibits a minimum deformation in case of shock and tends to send the vehicle back towards its carriageway. The separators belonging to this group are therefore relatively rigid or semi-rigid and are generally anchored to the ground and/or made of very massive elements. This separator group is the most used and comprises the concrete wall or concrete separator and the metal guard anchored to the ground or single or double lane rail made of supports driven into the ground, spacers and sliding elements.

The second group, conversely, tends to move in case of shock in order to absorb the energy of the shock. The separators of such group are deformed is and/or move therefore towards the opposite carriageway where they are installed as a central reserve over a distance depending on the conditions of the impact. These separators are generally used in temporary installations, building sites for example, or in areas where the deformation of the separator is not of paramount importance, i.e. areas where the central reserve is wide. Standards have been defined regarding the retention capacities of both these separators groups.

Here, the separators of the first group are considered more particularly; they are generally intended for occupying their long-term position or definitively between the carriageways. We shall use the term permanent separator throughout to designate them.

To enable communications through the central reserves comprising permanent separators, the said separators are discontinued, for example in the case of a highway, every two kilometers or so. At the corresponding places or communication zones, the separators are removable. However, for safety to be ensured throughout the highway, the retention capacity of the separators, at right angle to the said communication zone, must be sufficient and ideally with the same retention level or, still, equivalent to that of the upstream and downstream permanent separators. In known devices, opening easiness and rapidity are reverse functions of the retention capacity because of the presence of the anchoring system to the ground and/or the weight of the separators. If the retention capacity is smaller, the corresponding zone must be as short as possible and must therefore be arranged on a portion of the highway that does not exhibit any particular risk of cars losing control. Still, if for an emergency passage, the communication zone need only be a few meters wide, this communication zone must be a ten-meter wide for the traffic to be diverted from one side of the central reserve to the other. Besides, there are cases where diverting the carriageways must be contemplated on a regular basis. It is especially the case in the vicinity of toll stations or still in mountainous zones exhibiting galleries that must be maintained and where it is preferable to close the traffic completely by diverting it to the opposite carriageway.

Thus, if the state of the art knows communication zone retention devices is that can be open or closed by a single person without any heavy equipment, the latter only relate to a few ten meter-wide passages that can be used for diverting traffic carriageways and/or that exhibit smaller retention capacities with respect to the permanent separators.

The purpose of the invention is therefore to remedy these shortcomings and to suggest a discontinuance device for a central reserve in a communication zone between carriageways that exhibits a same level retention capacity or, still, close of those of the upstream and downstream permanent separators over a width ranging from a few meters to several tens of meters and that can be handled quickly and without any heavy equipment by one operator.

The invention therefore relates to a discontinuance device for a central reserve fitted with a permanent separator for a communication zone between carriageways exhibiting a closing position ensuring continuity of the separation of the carriageways and opening positions, respectively traffic emergency and diversion opening positions, where the carriageways are connected, made of fabricated metal modules and comprising supports driven into the ground.

SUMMARY OF THE INVENTION

According to the invention, the device comprises:

at least one arm consisting of at least one arm module, whereas the said module has two lateral walls, whereby the said arm is mobile in rotation around a vertical axle forming a joint at one of its ends, whereas the said arm comprises at least one pivoting retractable foot containing castors intended for lifting and bringing the said arm into rotation in order to ensure easy opening for traffic diversion;

a locking module mobile in translation on the arm in order to provide an emergency opening.

The invention also relates to the characteristics thereunder, considered individually or according to all their technically possible combinations:

two connection modules are arranged between both ends of the device and both ends of the permanent separators, whereas the said connection modules are intended for ensuring continuity of the separation with both adjacent permanent separators;

each support is arranged in a sheath driven into the ground, whereas the said support is retractable in order to be disengaged from the ground and arranged in a spacer, whereas the said spacer is integral with the lateral walls of an arm module;

the arm and locking modules have a trapezoidal profile, the lateral walls of the said modules are closed and ground-resting plates are arranged laterally at the base of the said modules, in order to strengthen the retention capacities of the said modules;

the arm module is rigidified by at least two ribs provided along each lateral wall and by at least one internal reinforcing piece;

each lateral wall of the locking module comprises along its internal face at least two U-shaped profiles for strengthening, whereas each of the said profiles comprises at least two lateral guiding castors distributed along the said profiles and one removable castor is arranged at one end of the said module;

each arm module intended for receiving the locking module that would then move to cover the former, comprises at its upper face at least one pair of castors;

the spacer comprises a joint so that the removable support, once retracted from the ground, can be tilted horizontally in order to remain inside the gauge delineated by an arm module;

the axle forming the joint is a support driven into the ground made of a round metal tube and the tube is arranged in at least one spacer comprising an adapted circular passage, whereas the said spacer is integral with the lateral walls of an arm module;

the device comprises a retention means intended for limiting the rotary opening of the arm up to a pre-set position;

the assembly between a first arm module and a second module of the same arm is obtained by bolting or keying the corresponding end of the second module on an integral linking frame and protruding from the first module;

the assembly between a first arm module and a second module of the same arm is obtained by covering-overlapping and bolting or keying the corresponding ends of the said modules;

the assembly between two modules of the same arm is ensured by bolting or keying an add-on part overlapping and covering the corresponding ends of the said modules;

as the device is closed, the locking module is keyed on the modules of adjacent arms;

the connection module arranged between the end of the arm comprising the joint and the permanent separator exhibits two closed lateral walls and comprises at its upper part a joint-holding arm;

the arm module is approx. 0.8 m in height, 0.6 m in width at the base, whereas the base is extended laterally by two ground-resting plates, each 0.15 m in width, 0.27 m in width at the apex for a 3.5 m length.

stops are provided on the arm modules in order to limit the covering translation movements of the locking module;

the rising or descending movements of the retractable pivoting axle comprising castors are controlled by a screw-jack type means or similar;

in one arm, the rising and descending movements of the retractable pivoting foot comprising castors and the rising and descending movements of the support can be controlled by a single synchronised means;

the current length of the device is at least 32 m and it comprises two arms, each of the arms consisting of at least four arm modules.

Other advantages and characteristics of the invention will become apparent from reading the description of embodiment examples in conjunction with the drawings.

DETAILED DESCRIPTION OF THE PREFERRED EMBODIMENTS

Figure 1:
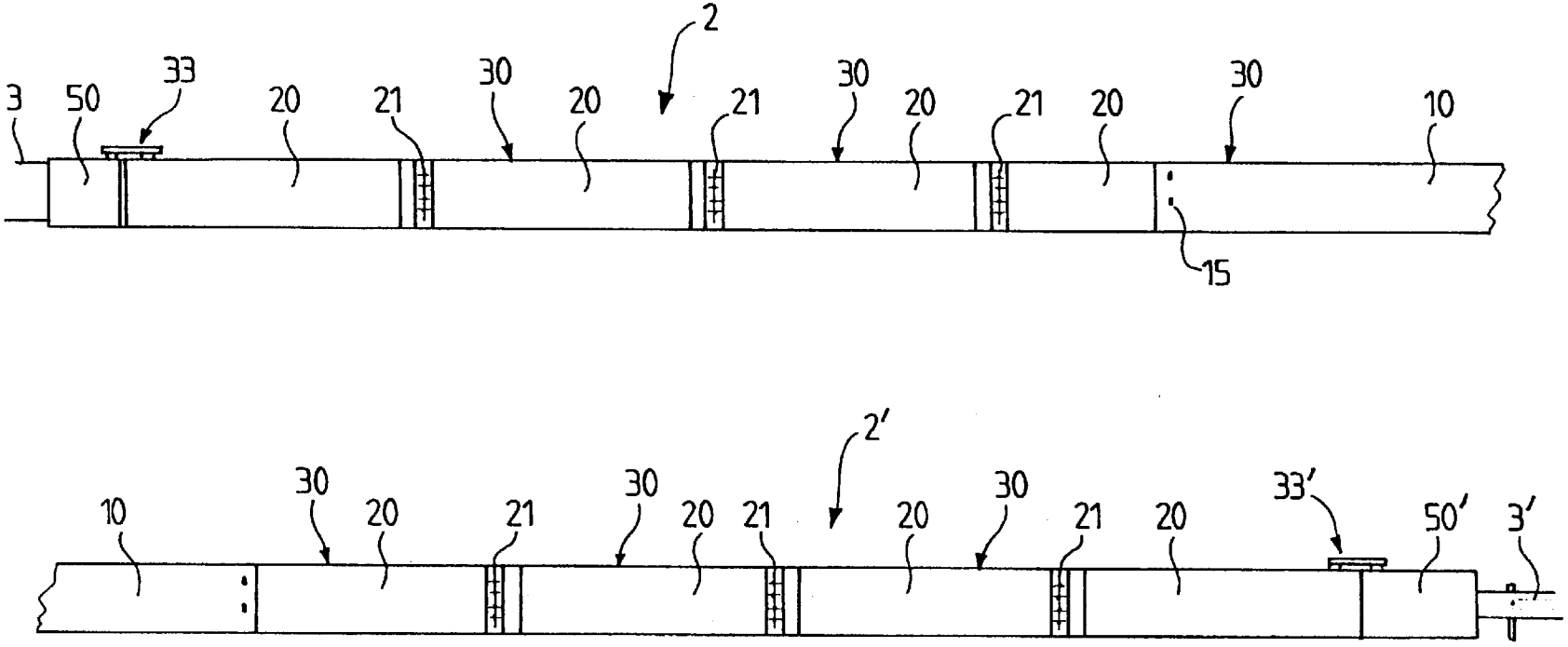
FIG. 1 represents a lateral view of a device in closed position.

FIG. 1 shows an embodiment of the device according to the invention. It comprises two articulated arms 2, 2' united by a locking module 10. The device is intended to be placed in a communication zone between two carriageways on a central reserve. A first end of the device is extended by a permanent separator of concrete barrier type 3 and a second end of the device by a safety rail 3' via two connection modules 50 and 50'. Each of the arms 2 and 2' consists of four arm modules 20, approx. 3.5 m in length, whereas an arm is then 14 meters in length. The arm modules 20 are united together at assembly zones 21. Each arm module 20 exhibits on each of both its lateral faces, continuous and closed, at least two ribs 23. The locking module 10 comprises two continuous plane lateral faces. Continuity means that the module is not open laterally, limiting the consequences in case of a collision with a motorbike. The width of the communication zone is then approx. 28 meters. Each arm 2 and 2' is mobile on the horizontal plane around a pivoting axle forming a joint 33 and 33' respectively. The joint 33 or 33' is situated at the end of the arm 2 or 2' adjacent to the corresponding connection module 50, 50'. The ends of the arms 2, 2' opposite the joints 33 and 33' are linked together via the locking means 10. The pivoting axle forming a joint 33 or 33' is driven into the ground substantially vertically so that the arms move into rotation horizontally over a horizontal communication zone. An arm module 20 comprises at least one support 30 or its equivalent in the form of the pivoting axle forming a joint 33, 33', which is driven into the ground. The modules forming the device consist essentially of galvanised steel sheets, reinforcing pieces, supporting spacers and are essentially hollow. The steel used exhibits at least the features of the steel S 235 JR according to French Standards NF EN 10 025 and sustains galvanisation according to French Standards NF A 35-503. Galvanisation will be obtained by quenching according to French Standards NF A 91-121.

Figure 2:
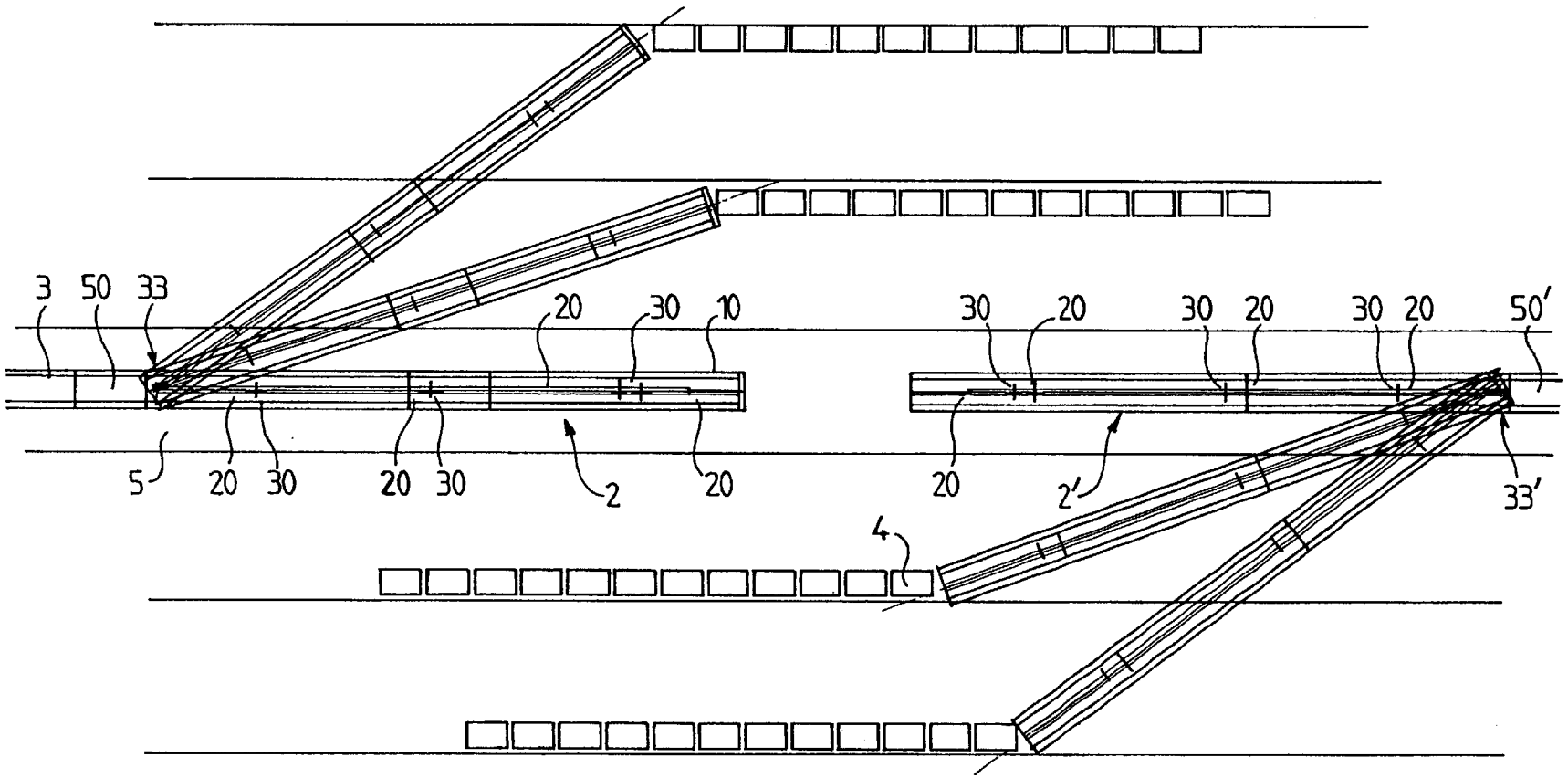
FIG. 2 represents a device in several opening positions and seen from above.

FIG. 2 shows the device in open position according to three possibilities given for exemplification purposes.

In a first position, both arms are collinear to one another on the central reserve 5 and the locking module 10 is translated by overlapping one of the arms 2 in order to provide an emergency opening in the communication zone. For a locking module of approx. 6 meters in length, an approx. 4 meter long emergency opening is obtained. The supports 30, in this position, are driven into the ground in their sheaths.

In the following opening configurations represented on the same FIG. 2, the arms have been moved into rotation around the joints 33 and 33' in order to allow switching between double and quadruple carriageway traffic according to the opening angle. Concrete blocks 4 can be placed ahead of the end of the arm and parallel to the traffic axis. In a particular embodiment, a hooking means is provided between the corresponding end of the arm and the concrete block. To enable the arms to rotate, the supports 30 have been extracted from the ground where they were inserted inside their sheaths. Once the device has reached its open position, the supports can be reinserted in the ground inside sheaths which, normally, when the communication is not open, will be closed by a covering system leveling with the road so that they cannot be filled by any debris or cannot disturb the traffic. Such a removable covering system may also be foreseen for the sheaths situated on the central reserve. The sheaths will then be closed when diverting the traffic.

Figure 3:
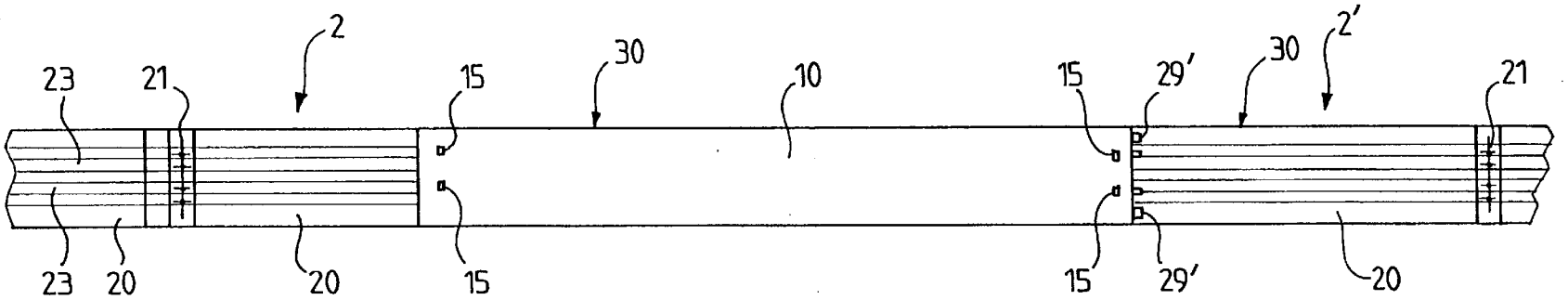
FIG. 3 represents a lateral view of the device detailing the locking module in closed position.

FIG. 3 is a view of the closed device according to FIG. 1 detailing more particularly the locking module 10 and the adjacent arm modules 20. The locking module rests on both its ends on the corresponding ends of the said arm modules. The locking module and the arm modules are keyed together via the keys 15. As the locking means can move by translation over the arm modules, stops are provided in order to limit the bottoming of the said locking module. A first series of stops 29' is arranged on the arm module 20 at the end of the arm 2', in order to stop the locking module 10 in closed position.

Figure 4:
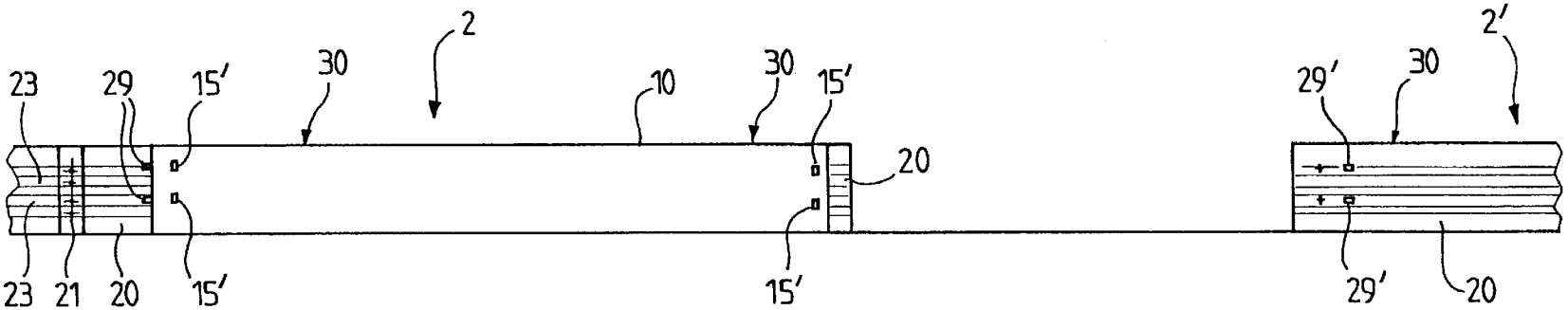
FIG. 4 represents a lateral view of the device detailing the locking module in an opening position.

FIG. 4 represents the device in a first opening position, whereas a second series of stops 29, blocking the locking module 10 in open position, is arranged on an arm module of the arm 2. The locking module has been translated by covering the arm 2. The keying means 15 have been removed and will be, preferably, stored in a receptacle provided in the device. However, when the opening must be kept, keying means 15' could also be used to fix the locking module in this opening position. Rolling means, described below, are used for that purpose and enable single-operator control of the locking module without any heavy means. The translation of the locking module can be facilitated by a handle or a removable thrust arm.

Figure 5:
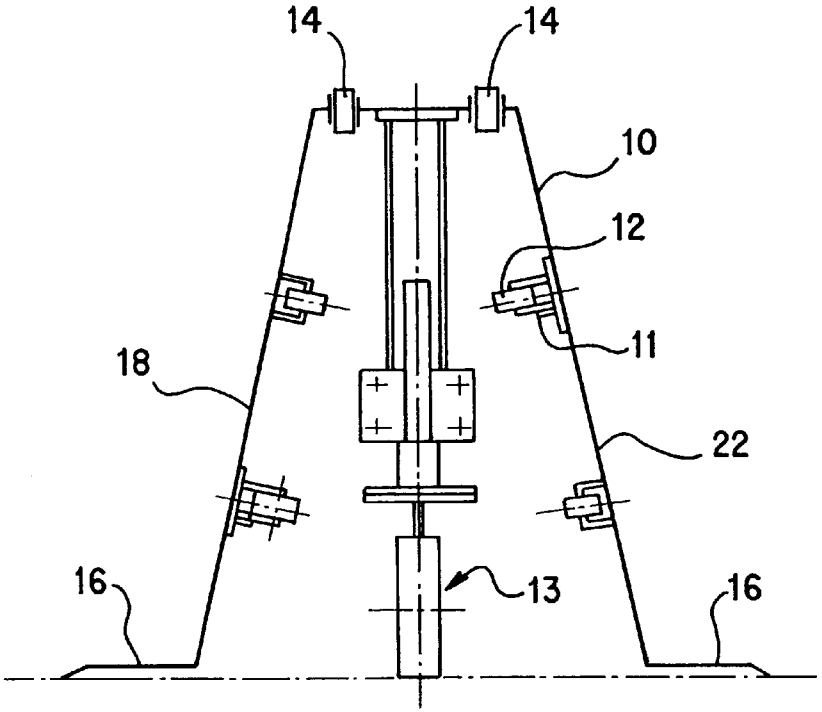
FIG. 5 represents a cross section of a locking module at a removable castor.

FIG. 5 represents a cross section of a locking module 10 at the end comprising a removable castor 13. The end comprising the said castor 13 is opposite the arm receiving in translation the said locking module so that the opening of the said translation and covering locking element can be maximum, whereas the arm modules 20 contain internally reinforcing pieces 26, supports 30 and other elements capable of opposing the internal passage of the said removable castor 13. In a closed device, the removable castor 13 is retracted and does not rest on the ground. When opening the device, the removable castor 13 is lowered or tilted to touch the ground. Lowering or tilting the castor can be obtained by any means known to the man of the art, i.e. a screw-type system, mechanical jack, pneumatic, hydraulic or electric jack. The castor will be preferably fixed and oriented to be able to roll into the locking module. Still, it is also contemplated that the castor should be mounted to pivot with respect to its supporting axle. This configuration is useful when the castor is still resting on the ground during the rotation of the corresponding arm for opening. The locking module 10 exhibits in its cross-section a substantially trapezoid and symmetrical shape, with a wide base, on the ground side, and an upper, opposite, narrow apex. The lateral sides connecting the ends of the base and of the apex as well as the upper wall forming the apex are substantially plane and continuous. The base of the module 10 is open. Two ground resting plates 16 are provided at the base of the module 10, laterally, along each side. These ground-resting plates are intended for improving the stability and the retention capacity of the device in case of shock, whereas the wheel(s) of the vehicle are pressing the resting plate to the ground. The internal faces of both lateral sides of the locking module comprise U-shaped metal profiles 11 designed for reinforcing the stiffness of the module. These profiles 11 are preferably welded and are each arranged at a height corresponding to the ribs 23, described below, of the arm modules 20 so that the translation of the module 10 on the arm 2 can take place undisturbed. Lateral guiding castors 12 are arranged along the said profiles 11. The lateral guiding castors 12 are intended for circulating in the ribs 23 provided on the lateral walls of the arm modules 20. The locking module is preferably realised from a single metal plate that is to folded. However, it is also contemplated to build the locking module by the reunion of two, or several, metal plates by welding and/or bolting.

Figure 6:
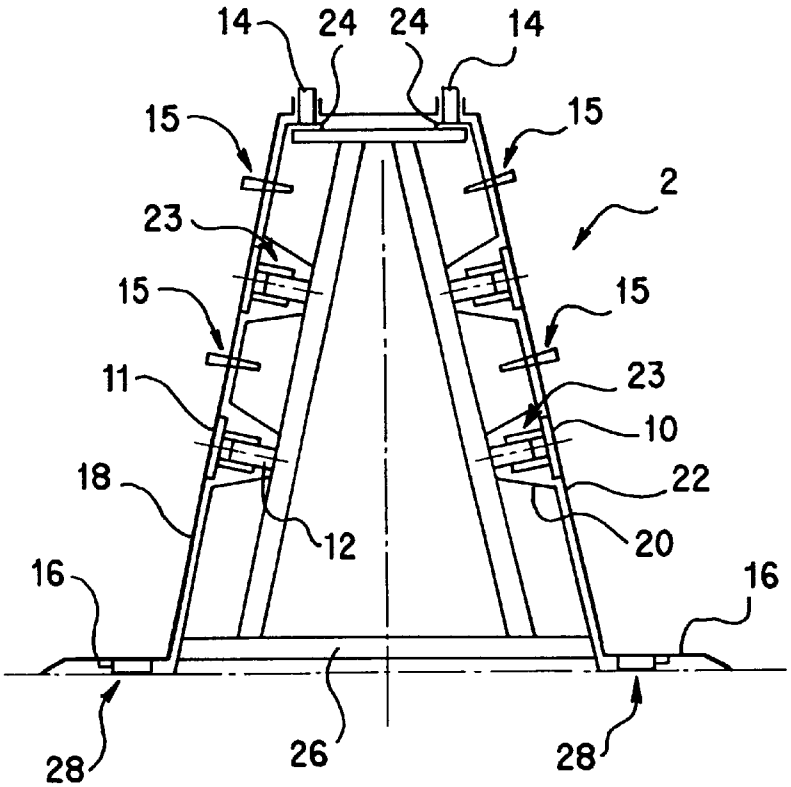
FIG. 6 represents a cross section of an arm at a locking arm according to a first embodiment.
Figure 7:
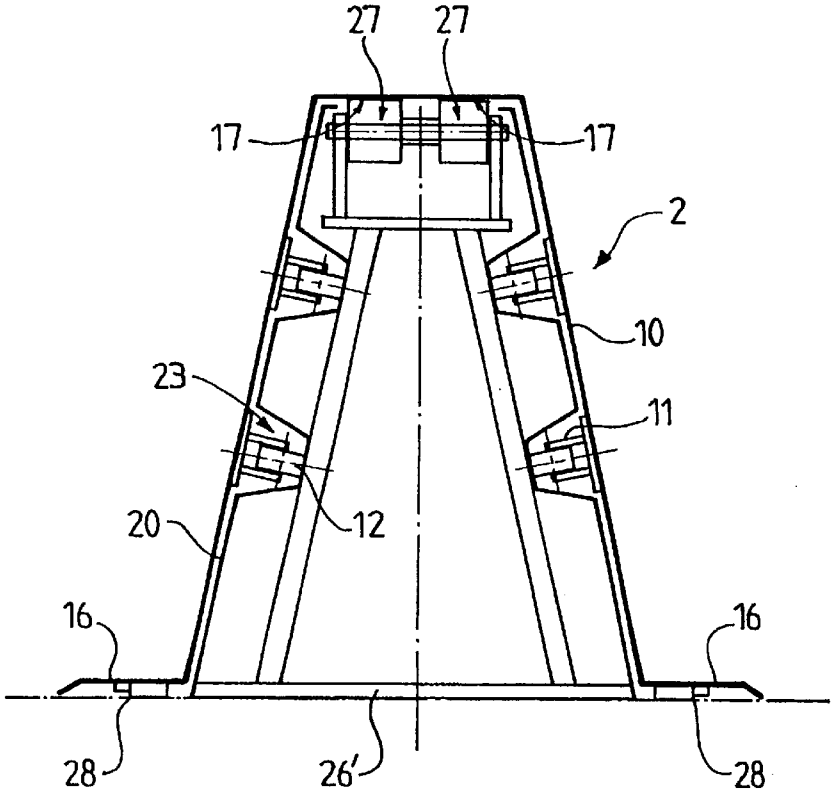
FIG. 7 represents a cross section of an arm at a locking arm according to a second embodiment.

FIGS. 6 and 7 enable visualising thanks to a cross section of an arm at a locking module, two embodiments of the system enabling the rolling of the locking module 10 on the arm modules 20 of the arm 2 at the upper part of the device. In the first embodiment, FIG. 6, at least one pair of upper guiding castors 14 is fastened to the apex wall of the locking module 10. Raceways 24 are available on the lateral parts of the upper face of the apex walls of the arm modules 20. The cross section goes through an internal reinforcing piece 26 of an arm module 20. The base of the internal reinforcing piece 26 could come down to the level of the ground resting plates 28. In this mode, only the locking means 10 comprises lateral 12 and upper 14 guiding castors, enabling covering translation of the said module 10 on the corresponding arm 2. This figure represents the keying means 15, however they may be arranged at other height levels and along the modules. In the second embodiment, FIG. 7, at least one pair of castors 27 is fixed towards the apex of the arm 2 and raceways 17 are available on the lower face of the apex wall of the locking module 10. The cross section goes through an internal reinforcing piece 26' carrying the pair of castors 27. In this mode, castors are also provided on the locking module and on the arm simultaneously.

The respective dimensions of the locking means 10 and of the arm modules 20 are suited so that the translation of the locking module 10 on the arm 2 takes place unimpeded. It can be noted on FIGS. 6 and 7 that the arm module 20 has ground-resting plates 28, at its base and laterally, which fulfill the same function as those, 16, of the locking module 10. However, the shape of the resting plates 16 of the locking module 10 enables their translation on those 28 of the arm module 20. It will also be noted that the centre portion of the apex of the arm modules is open, thereby providing access to the internal elements and in particular to the supports 30, to the castor-operated retractable pivoting axles 40 and allowing the passage of the removable castor 13 of the locking module 10. An arm module 20 has approximately the following dimensions: 0.8 m in height, 0.6 m in width at the base and 0.9 m integrating both ground resting plate 28, whereas each resting plate 16 or 28 is approximately 0.15 m in width. An arm module 20 is approximately 3.5 m in length. The locking module 10 is approximately 6 meters in length. The thickness of the metal plates is preferably 3 mm except for the locking module where a 4 mm thickness is preferred.

Figure 8:
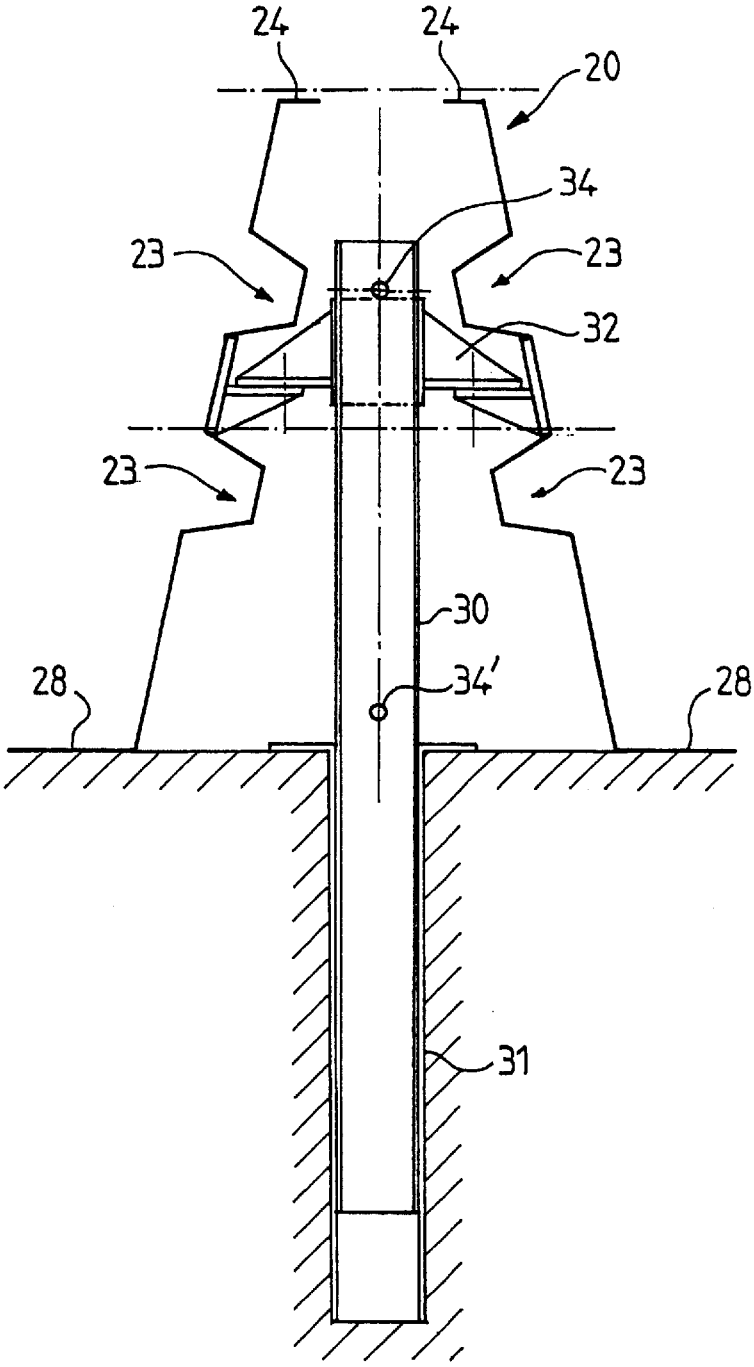
FIG. 8 represents a cross section of an arm module at a support.

FIG. 8 is a cross section of an arm module 20 at a support 30. In the device in idle position, closed position, the support is driven into the ground, inserted in a sheath 31. The sheath is driven in the ground. The arm module 20 has an external gauge whose trapezoidal shape is substantially equivalent to that of the locking module 10. The lateral walls of the arm module 20 exhibit however longitudinal ribs 23 intended for improving the stiffness of the device. In this embodiment, two ribs 23 per lateral wall are foreseen. Ground-resting plates 28 are arranged laterally on either side along a module in order to improve the stability and the retention capacity of the module in case of shock. The module will be preferably realised by the joining of two folded metal plates. The support 30 goes through a spacer 32, whereas the said spacer is fastened to both lateral walls of the arm module 20. In this particular embodiment, the spacer 32 consists of three elements bolted together. However, in other embodiments, the spacer can be realised as a single block and/or the elements can be welded together. As the support 30 is driven into the ground in a sheath 31, its length will be preferably such that the support will be comprised within the internal gauge of the arm module 20. In other embodiments, some of these supports may be longer and possibly protrude from the gauge of the standard module. Still, the end supports 30 of the arm 2 should not prevent covering translation of the locking means on the end of the said arm regardless whether they have been driven into the ground into the sheaths or they have been extracted. In order to maintain the support 30 with respect to the spacer 32, a removable blocking round 34 is provided either above the spacer in order to prevent the support 30 from coming down too deep inside the sheath 31 or through the spacer 32 and the support 30 in order to block any relative movement between both these parts. Two corresponding orifices are provided, in the support and, possible matching, in the spacer, in order to insert the said blocking round 34. Similarly, an equivalent blocking means can be foreseen between the sheath 31 and the support 30 in order to block any relative movement between both items when the support has been driven into the ground. This latter blocking means is placed below ground level so that the sheath does not protrude and it will be preferably masked by a cowling once the supports have been removed, whereas the device is open, so as not to disturb the traffic. The blocking rounds can be removed individually but it is also foreseen that they could be disengaged simultaneously from all the supports. In the latter case, all the rounds will be connected to a cable or to a rod assembly, and one or several return springs bringing the rounds back to engagement and blocking position will be provided. The operator will simply have to pull on the cable or on the rod assembly to disengage the rounds. A round's guide integral with the spacer will maintain the round in axial position during these engaging and disengaging movements. Transmission means will be provided between the bales or the rod assembly of the different modules assembled together.

To enable the opening of the communication zone, the supports 30 will be extracted from their sheaths 31 in order to disengage the former completely from the ground. The supports 30 could then be either removed completely from the device or left in place in the device while providing as previously a blocking round 34' arranged so that the support is immobilised in a position where it is not engaged any longer in the ground. In this latter case, the support protrudes from the upper part of the gauge of the standard module. This is a shortcoming at the end of the arm 2 where the locking module 10 must be translated by covering. Also, in this zone, the supports 30 should be removed preferably from the device. It is also contemplated in another embodiment that the spacer comprises a joint that enables horizontal tilting of the support once extracted from its sheath 31 so that the said support is totally comprised within the gauge of the arm module 20 and does not interfere with the opening of the locking module 10. The extraction from the sheath 31 of the support 30 can be performed by any means, manually, by a gear system or mechanical jacks and/or hydraulic and/or pneumatic and/or electrical jacks.

Figure 9:
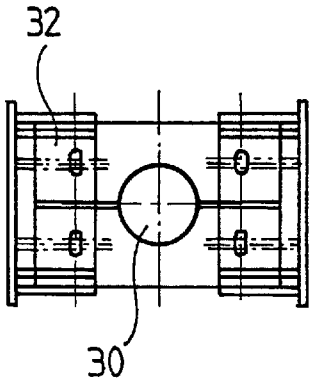
FIG. 9 represents an upper view of a support and of the corresponding spacer.
Figure 12:
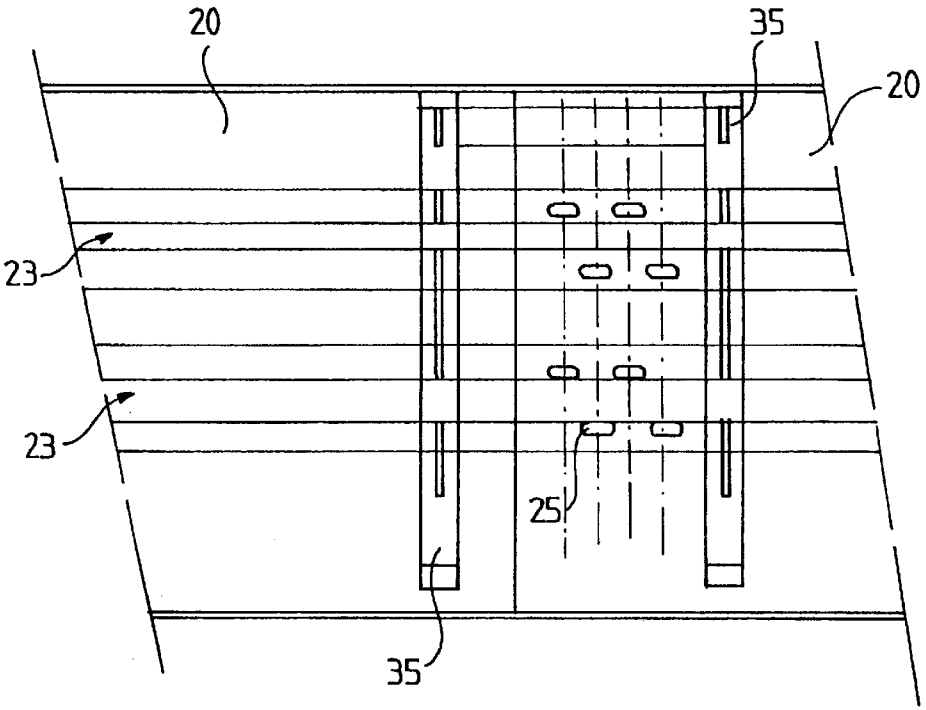
FIG. 12 represents a lateral view of a linking zone between two arm modules according to a first embodiment.

FIG. 9 represents the spacer 32 of FIG. 8 seen from above where the three elements are bolted together. The bolting orifices are preferably oblong to compensate for the clearances. The support 30 consists preferably of a metal tube with 101.6-mm diameter and 3.6 mm thickness, whereas the sheath is then 114.3 mm in diameter and 3.6 mm in thickness. The portion driven into the ground as well as the length of the sheath is approximately 700 mm, but this value will be adjusted in relation to the terrain. The diameter of the passage allowing the support to go through the spacer is 114.3 mm. However, it is also contemplated to use other forms of supports, for example U-shaped or square or rectangular. The pivot axle for rotation forming the joint 33 or 33' is essentially constructed according to the principles described for the supports. However, the axle selected will be a metal tube that enables rotation of the spacer, whereas the said tube is preferably fixed in place in the ground. Still, in other embodiments, whereby the pivot axle can be maintained at its upper part by a joint holding arm 38 or 38' of the connection module 50 or 50' as explained later, the tube can be put into the ground, in a sheath. Besides, more than just one spacer at the joint 33, 33' can be provided in order to strengthen the former. If both spacers are used for the joint, the first one will be placed facing the upper part of the arm module and the second facing the lower part.

Figure 10:
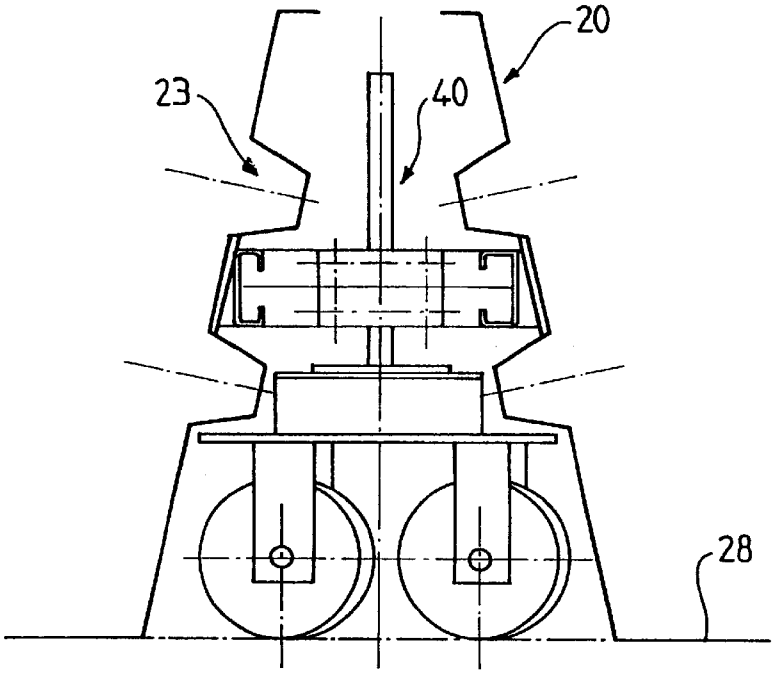
FIG. 10 represents a cross section of an arm module at a retractable pivoting foot comprising castors.
Figure 15:
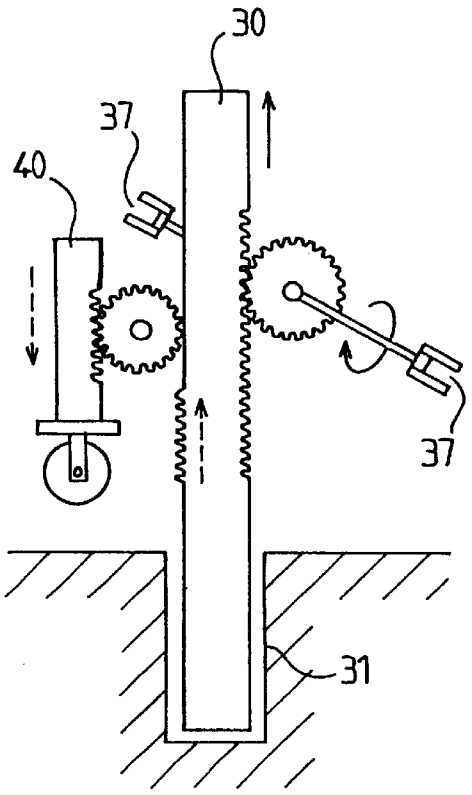
FIG. 15 represents an example of synchronised mechanical control of the supports and of the removable feet.

FIG. 10 represents a cross section of an arm module 20 at a retractable pivoting foot fitted with castors 40. Pivoting the foot enables, when the castors are on the ground, rolling in all possible directions. As the device is closed, the feet are removed and do not rest on the ground, whereby the modules then rest via supporting plates 28 on the ground. To open the device, the feet are actuated by any means that enables lowering them onto the ground via a gear system, a screw-type jack, a mechanical, pneumatic, hydraulic or electrical jack so that they rest on the ground and lift the module and hence the arm. As the arm is raised, the operator can easily open the device for diverting the traffic by pushing and pivoting the arms 2, 2' around their joints 33, 33'. Once the requested position of the arm has been achieved, the retractable pivoting feet with castors are retracted so that the modules rest again on the ground. The supports 30 may then be re-implanted in the ground and the ends of the arms may be fixed to concrete blocks 4. Preferably, the movements of all the castor feet 40 of the modules 20 of an arm will be synchronised via a common mechanical transmission such as transmission axle and gear, pneumatic, hydraulic or electrical jack. It is also contemplated that the retraction and/or positioning movement of the supports and the lowering and/or raising movement of the castor feet 40 should be synchronous. FIG. 15 gives an example of such a purely mechanical device where an incomplete rack only engages into the castor foot 40 when the support is disengaged sufficiently from its sheath. The other mobilisation modes will use actuating members controlled by contractors, valves or other equivalent items, operated in relation to the positioning of the supports 30 and the castor feet 40. In an arm module 20 comprising at the same time at least one support and at least one castor foot 40, the movements of both these elements are therefore synchronous, whereas a transmission 36 comprises at both its ends a coupling member 37 for joining with the matching coupling member of the transmission of the adjacent module or with a crank or any other device enabling setting the transmission in motion. It is however foreseen that the transmission could always be set in motion by a meshing and/or intermediate system. Similarly, synchronism can be provided with an arm 2,2' consisting of any type of different arm modules 20.

Figure 11:
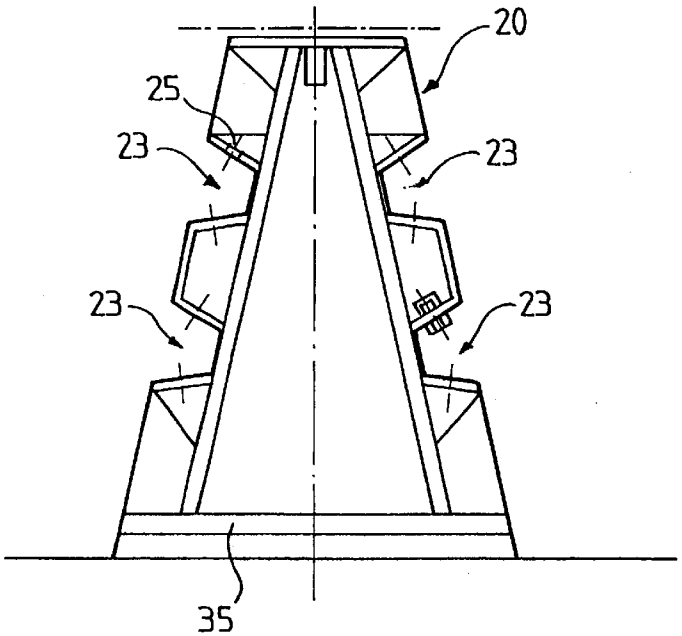
FIG. 11 represents a cross section of a link between two arm modules according to a first embodiment.

Several embodiments are considered for interconnecting two adjacent arm modules 20 at the assembly zone 21. FIG. 11 represents a cross section of the junction between two arm modules 20 according to a first embodiment. In this embodiment, the end of a first module 20 comprises internally a metal linking frame 35, whereas the said frame is welded to the said module and protrudes from the said. The corresponding end of the second module 20 comprises bolting orifices 25 on its lateral walls. These orifices are oblong in order to compensate for the clearances and the expansion of the metal. The said end of the second module is positioned on the protruding section of the linking frame of the first module in order to align the bolting orifices of these two elements. In addition to its mission as a linking element, the linking frame 35 plays an internally strengthening and realisation part, thus the lateral walls of the modules lie behind one another. It is also foreseen that the linking frame comprises means for allowing a support to go through, whereas the said frame fulfills then all the functions of a spacer and of a simple linking frame.

In other embodiments of the linking system, it is contemplated that the link between two arm modules consists in covering lateral walls according to two possibilities. In the first one, by partial overlapping of the ends of the modules, the end walls of one of the modules are offset, i.e. either recessed or protruding with respect to the general plane of the walls. Ends of both types are then defined, on the general plane and outside the general plane, and can be coupled. In the second possibility, overlapping add-on plates will be bolted to the walls of both ends of both adjacent modules as external or bilateral fishplates.

Figure 13:
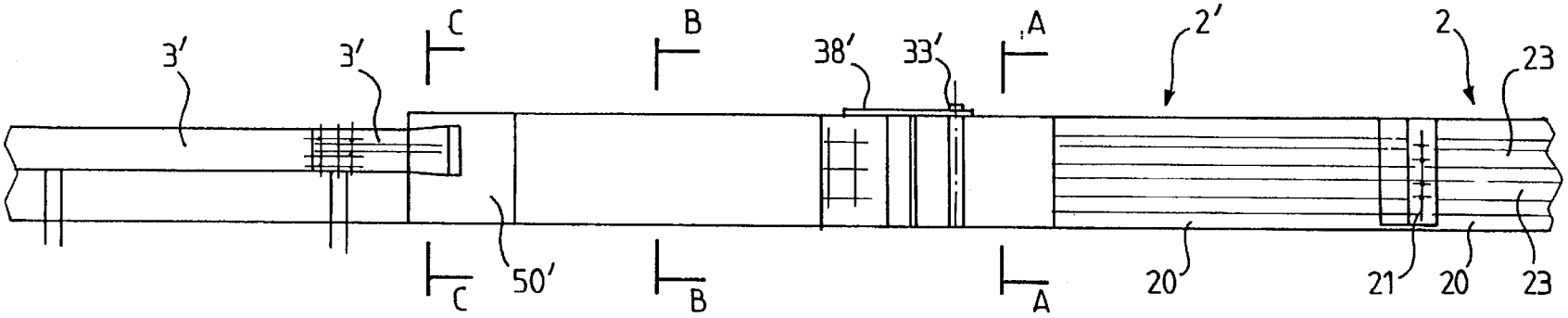
FIG. 13 represents a lateral view of the connection zone between a permanent metal rail and the device according to the invention.
Figure 13C:
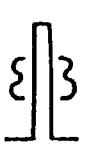
FIGS. 13*a*, 13*b*, 13*c* represent cross sectional views of the device of FIG. 13 along the sections A—A, B—B and C—C respectively.
Figure 13B:
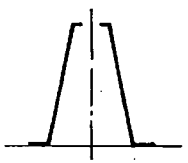
Figure 13A:
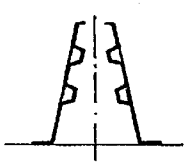

FIG. 13 represents the connection zone between a permanent separator such as a safety rail 3' and an arm 2 of the device. A connection module 50' is arranged between the end of the rail 3' and the end of the arm 2' comprising the joint 33'. The connection module 50' exhibits a beveled end that can be inserted between both metal profiles of the rail 3, as visible on FIG. 13*c*. In this particular embodiment, a joint holding arm 38' is fixed to the upper section of the end of the connection module 50', on the arm side 2'. The holding arm 38' enables fastening the upper part, protruding from the arm module 20, of the pivoting axle forming a joint 33'. In other embodiments, and in particular when the pivoting axle forming a joint is anchored to the ground, the holding arm 38' can be omitted. The connection module 50' will be preferably fixed to the end of the rail 3' and will comprise preferably internal reinforcing pieces and one or several supports driven into the ground that will be preferably anchored to the ground. The approximate length of this connection module is 3.50 meters. The lateral walls of the arm module 20 comprising the joint 33' will be preferably covered towards the joint so that the ribs 23 are masked, whereas the lateral profile is then similar to that of the connection module 50', FIGS. 13*a* and 13*b*.

Figure 14:
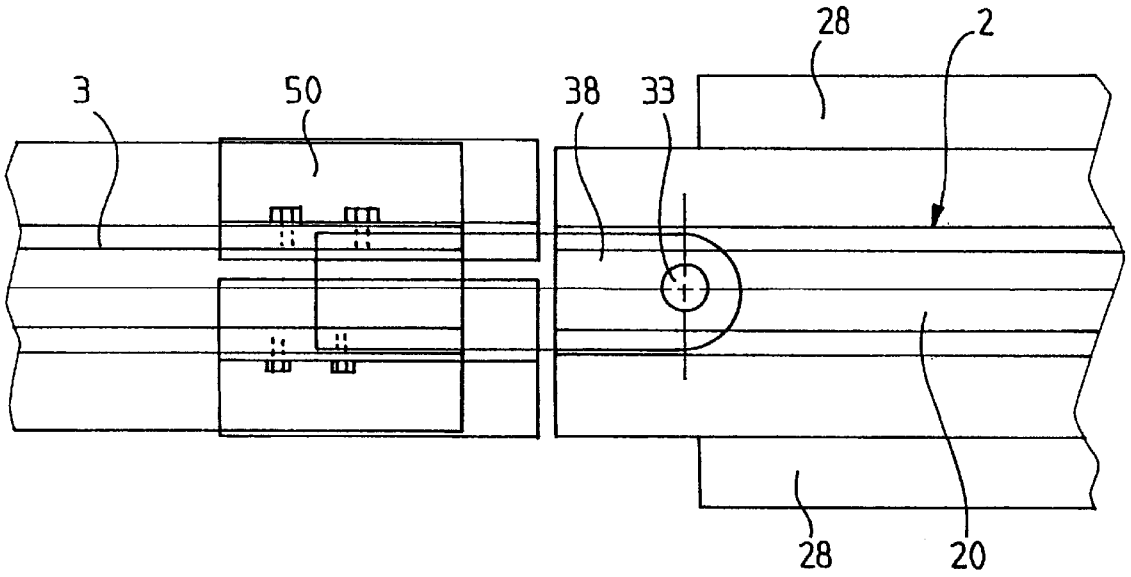
FIG. 14 represents an elevation view of the connection zone between a concrete wall and the device according to the invention.

FIG. 14 represents an upper view of the connection zone between a permanent separator such as a concrete wall 3 and the articulated end of an arm 2. The connection arm 50 comprises a joint-holding arm 38. The arm 38 is fixed to the upper section of the pivoting axle forming a joint 33. The approximate length of this connection module is 1.50 meters in order to be able to switch from the profile of the concrete permanent separator to the profile of the arm modules. The module 50 will be preferably bolted to the end of the permanent separator 3.

On FIGS. 6, 7, 8, 9, the cross section goes through metal reinforcing pieces 26 and 26' or spacers 32 inside the arm modules. These elements are intended for interconnecting the lateral walls and for reinforcing the structure of the arm modules 20. The respective numbers of internal reinforcing pieces 26, 26', spacers 32, inside the arm modules 20 or the connection modules 50, 50' will depend of the retention capacity required for the device. For a 3.5 meter long arm module comprising a module-linking frame 35, one support and one internal reinforcing piece are provided preferably. If higher retention capacity is required, at least two supports and two reinforcing pieces will be provided. However, all the possible combinations of numbers of these elements are contemplated, whereas the purpose is to obtain sufficient retention capacity at the best price. The modules 10, 20, 50, 50' are preferably symmetrical with respect to a longitudinal vertical middle plane.

Tests performed with a two-arm device with total length of 32 meters, have shown that the opening for diverting the traffic could be carried out by a single operator without any particular heavy equipment, especially lifting equipment, in less than 15 minutes. The operator can push each arm over a road exhibiting an axle camber in the order of 4%, no load heavier than 40 kg needs to be carried, in spite of an arm weight greater than 1500 kg. During this process, the operator is protected by the device.

The reference signs inserted after the characteristics mentioned in the claims solely aim at facilitating the understanding of the latter and do not limit their extent in any way. Moreover, the examples of embodiments are only given for informative and illustrative purposes and all the possible combinations of these examples as well as the variations are part of the description. In particular, a device comprising one arm only is contemplated. It comprises a first connection module on the upstream permanent separator, a joint-operated arm, a locking module according to the previous description and a second connection module that can accommodate the end of the locking means and be keyed to the same. The said second connection module can be coupled to the downstream permanent separator. Moreover, the operation of the device may be partially or totally controlled remotely, whereby electrical, pneumatic, hydraulic actuating members and detectors would ensure and monitor the movements of the different mobile elements. It is also contemplated that the arm modules 20 are partially or totally standardised and that they can be used indifferently along a given arm. In such a case, the embodiment presented on FIG. 6 will be preferred, the stops 29 and 29' will be removable to be placed solely to suit the requirements and the linking mode between the modules 20 will be chosen accordingly, either the module 20 does not comprise any linking frame or a covering system is selected. The control of the movements of the supports 30 and of the retractable pivoting feet fitted with castors 40 can be transmitted, as indicated, commonly and synchronously or not. The same goes for the blocking rounds 34. Besides, this(these) transmission(s) can take place commonly along the arm for all the mobile members. For example, a longitudinal transmission axle could be terminated at each end of a module with a coupling device that enables, when the arm modules are joined, to couple and to transmit the control from one end of the arm to the other and to the following arm. Finally, it is foreseen that a means enabling to limit the bottoming of the arm when rotating, a retaining means, should be included in the device. This means could be a brake acting on the castors of one or several retractable pivoting axles 40, a cable linked to the arm and anchored to the ground on the central reserve, a stop anchored to the ground close to the joint according to two positions or a simple wedge resting on the ground at the requested location for the arm in opening position for diverting the traffic.

What is claimed is:

1. A discontinuance device for a central reserve fitted with a permanent separator for a communication zone between carriageways, exhibiting a closing position ensuring continuity of the separation of the carriageways and rotation opening positions for diverting the traffic, where the carriageways are connected wherein the device comprises fabricated trapezoid metal modules comprising closed lateral walls, wherein said metal modules comprise retractable supports engaged in sheaths driven into the ground, wherein said supports are placed in spacers, and said spacers are integral with lateral walls; at least one arm with two opposite ends comprising at least one arm module, said at least one arm at a first end is mobile in rotation around a vertical axle forming a joint and said at least one arm comprises at least one retractable pivoting foot with castors for lifting and enabling the rotation of said at least one arm round the joint in order to ensure opening for diverting the traffic and a locking module having two lateral walls with a translation-mobile trapezoid profile on a second end of said at least one arm in order to provide an emergency opening, wherein each lateral wall of the locking module comprises along an internal face at least two U-shaped profiles for strengthening purposes, each of said profiles comprises at least two lateral guiding castors distributed along said profiles and in that a removable castor is arranged at one end of said locking module.

2. A device according to claim 1, further comprising ground-resting plates provided laterally at the base of said modules in order to reinforce retention capacities of said modules.

3. A device according to claim 1 or 2, wherein the arm module is stiffened by at least two ribs arranged along each lateral wall and by at least one internal reinforcing piece.

4. A device according to claim 1, wherein the locking module comprises at its upper part at least two pairs of upper guiding castors distributed along said locking module.

5. A device according to claim 1, wherein each arm module receiving the locking module by translation-covering, comprises at an upper part at least one pair of castors.

6. A device according to claim 1 wherein said spacers comprise a joint so that the retractable support, once retracted off the ground, can be tilted horizontally in order to rest inside a gauge delineated by the arm module.

7. A device according to claim 1, wherein the axle forming the joint is a support driven into the ground comprising a round metal tube, and the tube is arranged in at least one of said spacers and comprises an adequate circular passage, wherein said spacer is integral with the lateral walls of the arm module.

8. A device according to claim 1, wherein in said at least one arm, a assembly between a first arm module and a second arm module consists in bolting or keying a corresponding end of the second module on a linking frame integral with and protruding from the first module.

9. A device according to claim 1, further comprising two connection modules intended for ensuring a continuous separation with two adjacent permanent separators, and in that a connection module arranged between an end of said at least one arm comprising the joint and the permanent separator exhibits two closed lateral walls, and in that the connection module comprises a joint-holding arm at an upper part.

10. A device according to claim 1, wherein the at least one arm module is approximately 0.8 m in height, 0.6 m in width at the base, whereas the base is extended laterally by two ground-resting plates, each 0.15 m in width, 0.27 m in width at the apex for a 3.5 m length.

11. A device according to claim 1, wherein a screw-jack type means controls the rising or descending movements of the retractable pivoting axle comprising castors.

12. A device according to claim 1, wherein in said at least one arm, rising and descending movements of the retractable pivoting foot comprising castors and rising and descending movements of the support can be controlled by a single synchronized means.

13. A device according to claim 1, wherein the length of the device is at least 32 m and that it comprises two arms, each of the arms comprising at least four arm modules.

* * * * *